United States Patent [19]

Tesch

[11] Patent Number: 4,466,238

[45] Date of Patent: Aug. 21, 1984

[54] EXTENSIBLE LINK BAND

[75] Inventor: Bernhard Tesch, Ennetbürgen, Switzerland

[73] Assignee: Tesch A.G., Ennetbürgen; Zwyro A.G., Shaffhausen, both of Switzerland

[21] Appl. No.: 498,671

[22] Filed: May 31, 1983

Related U.S. Application Data

[63] Continuation of Ser. No. 180,105, Aug. 21, 1980, abandoned.

[30] Foreign Application Priority Data

Aug. 25, 1980 [DE] Fed. Rep. of Germany ..... 2934455

[51] Int. Cl.[3] ..... F16G 13/00

[52] U.S. Cl. ..... 59/82; 59/90

[58] Field of Search ..... 59/82, 80, 90, 85, 79.3, 59/91; 63/3; D11/93, 94

[56] References Cited

U.S. PATENT DOCUMENTS 4,010,604 3/1977 Tesch ..... 59/82

FOREIGN PATENT DOCUMENTS 2740916 3/1979 Fed. Rep. of Germany ..... 59/80

22955 2/1977 Japan ..... 59/80

233717 5/1925 United Kingdom .

282272 5/1927 United Kingdom .

2056844 3/1981 United Kingdom ..... 59/80

2055551 3/1981 United Kingdom ..... 59/82

*Primary Examiner*—Francis S. Husar

*Assistant Examiner*—Linda McLaughlin

*Attorney, Agent, or Firm*—Diller, Ramik & Wight

[57] ABSTRACT

This disclosure relates to a link band, in particular a watch wrist band, a bracelet or the like which includes a plurality of links defined by opposite longitudinal edges, opposite transverse edges, and opposite upper and lower surfaces; adjacent links being articulately interconnected by projections received in recesses, the connection between an end of a projection and an associated recess having an axis of rotation located contiguous adjacent longitudinal edges and upper surfaces of adjacent links, and the articulating connections being such as to absorb longitudinal forces imparted to the link band when in use and to also lock adjacent links together against unlocking movement of the links perpendicular to a longitudinal plane of the link band.

17 Claims, 12 Drawing Figures

Figure 5:
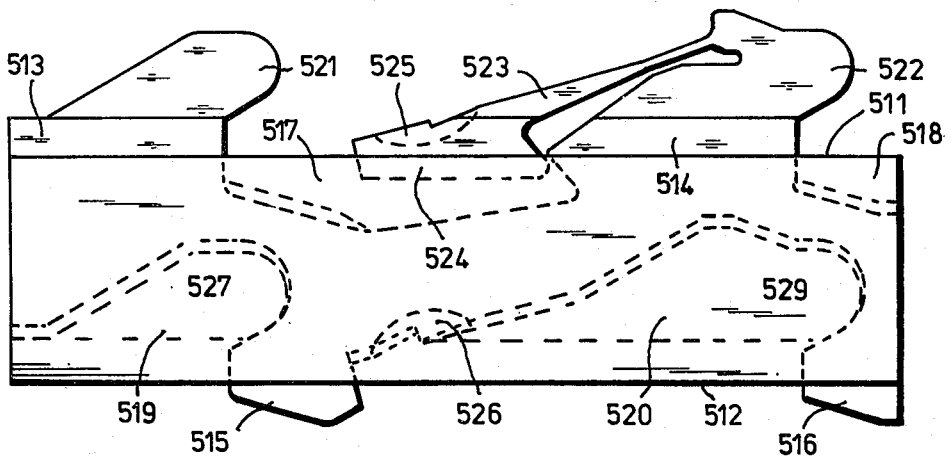

FIG.1a
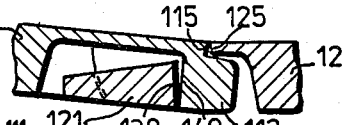
FIG.1b
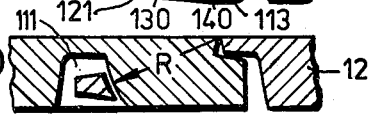
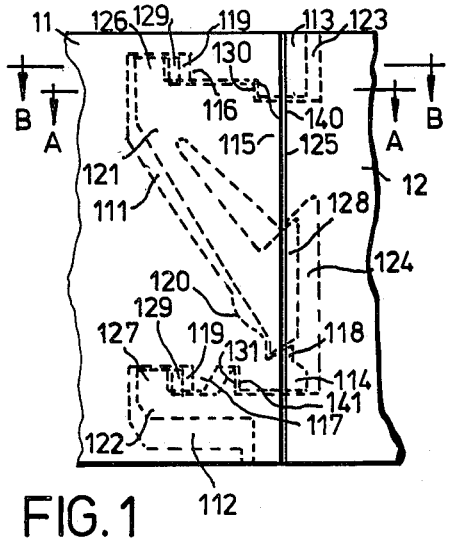
FIG. 1
FIG.2a
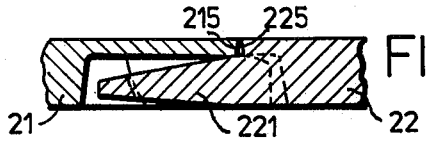
FIG.2b
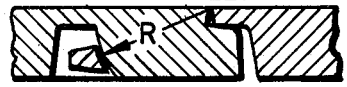
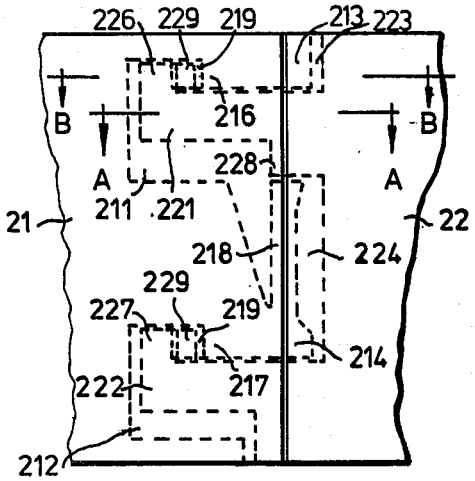
FIG. 2
FIG.3a
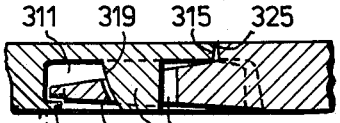
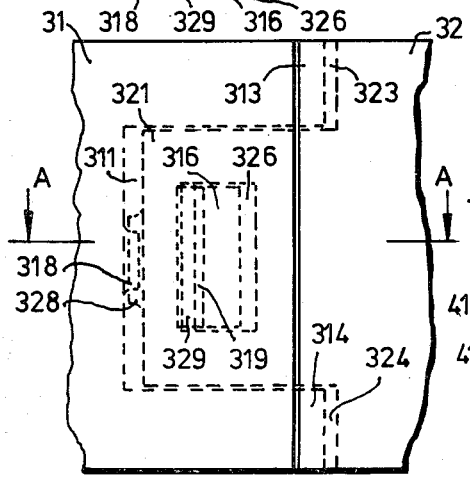
FIG. 3
FIG.4a
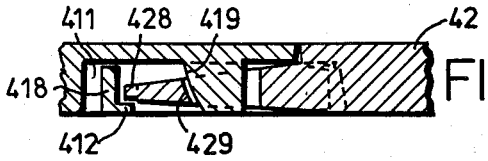
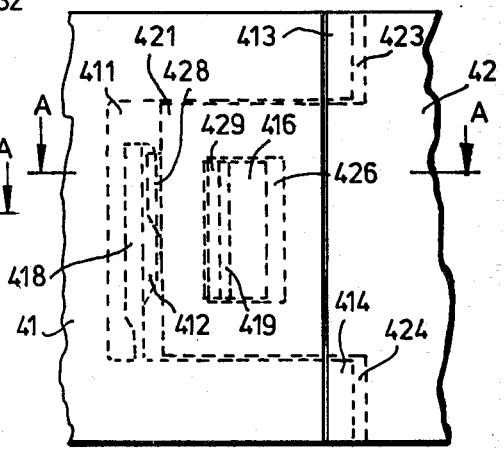
FIG. 4

EXTENSIBLE LINK BAND

This application is a continuation, of application Ser. No. 180,105, filed 8/21/80 now abandoned.

The present invention is directed to an extensible or articulated link band, particularly a watch wrist band or a bracelet, but also usable as a belt. The link band consists of a plurality of individual links joined in an articulating manner and being provided at opposite longitudinal edges with mutally engaging articulating connection means in the form of connecting elements which in the assembled or interlocked state form a joint connection holding the links tightly together along longitudinal sides or edges thereof.

Such link bands assembled from individual links provide the appearance of a uniformly closed band if the individual links are properly shaped and joined together tightly enough when the band assumes a flat position. However, when used as a watch band, they must usually be bent more or less as, for example, when being placed around the wrist of the user. This bending and inward or inside direction is desirable, but bending in an outward or outside direction though desirable should also be limited.

Due to the latter conditions or desires associated with link bands, a number of requirements is placed on the articulating connections of associated adjacent links which are not only difficult to meet but also are generally somewhat in conflict. For example, in an known embodiment of a link band, the links are articulately joined together such as to retain an essentially uniform practically trivial or minuscule spacing between adjacent links for most any conditions of bending. In such a band, however, when in the curved or bent state, the links due to their design assume a mutual position in which they abut each other like steps or stairs in the manner of roof shingles or tiles with the height of the steps increasing with the bending.

In other link bands the gap or spacing between two adjacent links changes as the band is bent and in order that the band also be somewhat outwardly bendable, this gap must also be present to some degree when the band lies flat. Thus, this gap generally increases mainly in the sense of increasing band curvature and thus decreases as the curvature of the band decreases. In order that such a gap does not become excessive in appearance, ribs or projections which project transversely of longitudinal edges of one or more adjacent ribs are provided to underlie the gap and, therefore, block the interior of the band to one's view, thus rendering the gap less visible though it is still present. Even with the latter solution, the gap between adjacent links remains more or less visible in part because the view blocking projections or ribs must be located as close as possible to the outside of the band, while a minimum material thickness must be preserved for band integrity and strength. Obviously, a further difficulty is that such wrist bands are relatively thick to provide strength at the articulating joints or elements, but as the thickness of the bands or the links associated therewith is reduced, the available space for interconnecting adjacent links and for closing or hiding the gap therebetween becomes a more difficult problem.

It is a primary object of the present invention to avoid the latter-noted shortcomings and difficulties in previously known designs of link bands and to create a link band such that the interconnected links and particularly the connecting elements thereof not only offer an extensively step-free outside surface appearance in all bent positions of the individual links relative to each other, but also is free of any significant gaps between the individual links.

A link band of the latter type can be achieved by this invention because the axis of rotation of the articulating connection of adjacent links lies approximately at or in the outer surface of the link band and in the area of the gap defined by the longitudinal edges of adjacent links, while at the same time those portions of the links which form articulating bearing pins and bearing sleeves are located remote from the axis of rotation. In order to employ bands which are generally thin, the elements forming the articulating connection may be divided or categorized into groups of elements and in such cases, one or several of the elements making up a group will absorb the bands longitudinal forces while others function to secure the links against movement or forces perpendicularly to the plane of the band. The group of elements absorbing the longitudinal forces can appropriately comprise the elements acting as the articulating connections (bearing bins and bearing sleeves) or consists of such comparable elements.

A wide variety of designs can be implemented due to the construction of the present invention. For example, one or several projection means, such as lips, tenons, projections and/or shoulders can be provided along longitudinal edges or sides of adjoining links with corresponding recesses being formed on the other sides of these links which are mutually and alternatingly arranged for mating engagement in a comb-like fashion. These projection means and associated recesses secure the position of the links perpendicularly to the plane of the band and are located as close as possible to the other side of the band. The projection means furthermore can be provided with cylindrical surfaces or segments as surfaces acting as bearing sleeves which, when the links are lined up one against the other, will engage behind cylindrical surfaces or cylindrical surface segments—arranged coaxially with the axis of pivot motion or of rotation of the links and acting as bearing pivots—the recesses of the neighboring links. The projection means and recesses may be of such a design that the links are connected by hooking one into the other, namely, one projection within one recess. This connection also permits ready detachment of adjacent links even with the same being locked together by an appropriate locking element which appropriately is formed as an integral homogeneous part of the individual links of the link band. Though preferably integral, such locking element may, of course, be a separate element.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a fragmentary top plan view of two links of a link band, and illustrates a pair of projections of one link received in a pair of recesses in another link and a locking element spanning a gap between longitudinal edges of the links.

FIG. 1*a* and FIG. 1*b* are cross-sectional views taken respectively along lines A—A and B—B of FIG. 1, and illustrates details of the articulating connection between the adjacent links of the link band.

FIG. 2 is a fragmentary top plan view of another link band constructed in accordance with this invention, and illustrates a pair of projections of one link received in a pair of recesses in another link and a locking element spanning a gap between longitudinal edges of the links.

FIG. 2*a* and FIG. 2*b* are cross-sectional views taken respectively along lines A—A and B—B of FIG. 2, and illustrates details of the articulating connection between the adjacent links of the link band.

FIG. 3 is a fragmentary top plan view of another link band of this invention, and illustrates a pair of links including a projection of one having an opening which receives a cleat of another.

FIG. 3*a* is a sectional view taken generally along line A—A of FIG. 3, and illustrates the interengagement of the cleat and opening of FIG. 3.

FIG. 4 is a fragmentary top plan view of another link band of this invention, and illustrates a pair of links including a projection of one having an opening which receives a cleat of another.

FIG. 4*a* is a sectional view taken generally along line A—A of FIG. 4, and illustrates the interengagement of the cleat and opening of FIG. 4.

Figure 6:
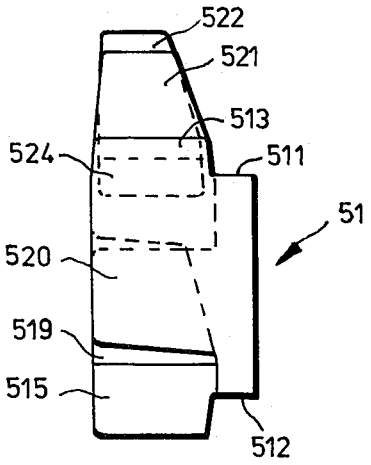

FIG. 5 is a top plan view of another link of this invention, and illustrates two projections one of which carries a locking arm with a recess between the projections and two recesses with a projection between the recesses with the link being illustrated being interconnected with identically constructed nonillustrated links FIG. 6 is an end view of the link of FIG. 5 looking from left-to-right in the latter figure, and illustrates further details of the link.

Reference is first made to a novel link band (FIG. 1, FIG. 1*a* and FIG. 1*b*) which may be, for example, a watch wrist band, a bracelet, or belt or the like and is formed of a pair of mutually joined links 11, 12 of which the link 11 comprises recess means or recesses 111, 112 along a longitudinal side or edge 115, then are penetrated by or received projections 121, 122 located along an adjoining longitudinal side or edge 125 of a neighboring link 12. The link 11 also includes projections 113, 114 which are received in recesses 123, 124, respectively, of the link 12 when, of course, the links 11, 12 are adjacent and interlocked with each other, as is shown in FIGS. 1, 1*b* and 1*a*. The latter effects a comb-like interconnection or meshing of the projection means and link means which in effect results in an articulating connection, as in the form of a hinge, and also secures the position of the links 11, 12 perpendicular to the plane of the overall band.

The links 11, 12 push against each other along their longitudinal sides or edges 115, 125. In order to absorb these tension forces in the longitudinal direction of the link band, the projections 121, 122 are provided with means in the form of end portions, arms or attachments 126, 127, respectively, which rests or seat behind respective offsets 116, 117 of the respective recesses 111 and 112 of the link 11. The parts of the two links engaging in the manner thus described are designed as cylindrical surfaces 119, 129, and the same are concentric to the axis of rotation or the pivot axis of the links which is located in the area of the gap (unnumbered) between the two longitudinal edges 115, 125 near their upper surfaces thereof, as is best indicated by the radius R in FIG. 1*b*. Thus, the axis of rotation lies at the end of the lead line associated with the arrow R remote from the head of the arrow thereof which in FIG. 1*b*) is shown terminating just at the gap between the longitudinal edges 115, 125 of the respective links 11, 12. The angled arms or attachments 126, 127 form bearing pins or bearing portions which impart the pivoting capability to the links 11, 12 and also permit some outward bending of the link band to a moderate degree, as is evident in FIG. 1*a*. The outward bending of the links 11, 12 relative to eah other is limited by abutment surface means in the form of heels 130, 131 which abut one another in the manner best illustrated in FIG. 1*a* as they contact cooperative abutment surface means or heels 140, 141, respectively, of the projection means 121, 122. Thus, when the links 11, 12 are pivoted relative to each other, the cylindrical surfaces 129 (FIG. 1*b*) act as bearing sleeves which move over the cylindrical surfaces 119 acting as the bearing pins.

When the links 11, 12 are in their lined-up position (common single plane), they are secured by releasable locking means consisting of an integral locking shoe or terminal locking end portion 128 formed as an integral extension of the projection 121. The integral extension or locking shoe 128 is flexible and deflectable due to its inherent elasticity and, thus, the locking shoe or arm 128 can be pressed back into the recess 124 in which it is located when the links are hooked together. In the latched state, the locking shoe 128 presses in the manner of a ratchet pawl or tooth behind a similar protruding pawl or tooth 118 of the projection 114 of the link 11. The locking shoe or element 128 further functions as means for blocking ones' view into the interior of the link band through the gap between the longitudinal edges 115, 125 by, of course, spanning the gap therebetween. However, the links 11, 12 can be slightly parted across the gaps 115, 125 when the locking shoe 128 is pressed back from the lower side of the band into the recess 124 using an appropriate tool that can be inserted into a depression 120 of the projection 114.

Reference is now made to the link band of FIG. 2 which corresponds generally to that of the link band of FIG. 1 with identical elements being similarly numbered but being in the 200 rather than the 100 series. The articulating connecting or connection means and the manner in which the same are secured in position are achieved by projection means or projections 221, 222 of the link 22 and like projections 213, 214 of the link 21. The projection 221, 222 are received in respective recesses 211, 212 of the link 21, while portions or projections 226, 227 of the projections 221, 222 have cylindrical surfaces or segments 229 which engage and mate with cylindrical surfaces or segments 219 of heels or surfaces 216, 217, and thus seat themselves into the recesses 211, 212, respectively. In this case, a locking element 218 is carried by the projection on lip 214 or the link 21 and is received in the recess 224 of the link 22 and in spanning relationship to the gap between the longitudinal edges 215,225 with the locking element 218 acting as a view blocking means. In the latched state, the locking element or shoe 218 rests against a pawl 228 of the link 22.

Reference is now made to FIG. 3 of the drawings in which is illustrated links 31, 32 having longitudinal edges 315, 325 between which is a gap (unnumbered). The link 32 includes a projection 321 received in the recess 311 of the link 31, whereas the latter link 31 includes projections or shoulders 313, 314 received in recesses 323, 324, respectively, of the link 32. The projections 321 of the link 32 tapers or converges toward its free end, as is best illustrated in FIG. 3*a* and includes an essentially rectangular opening 326 into which enters a tongue or cleat 316 provided at the lower side (unnumbered) of the link 31. The cleat 316 is provided at the side thereof facing away from the longitudinal edges 315, 325 with a cylindrical surface 319 acting as a bearing surface or pin with a cylindrical surface 329 of the side wall of the opening 326 cooperating with the surface 319 and acting as a bearing sleeve. In this matter, the mutual mobility of the links 31, 32 and the absorption of the tensile forces in the longitudinal direction are ensured by the cooperative cylindrical surfaces or segments 319, 329. Preferably, a tongue 318 is bent from its dotted position shown in FIG. 3*a* to its solid outline position in this same figure to lock the tongue or projection 321 within the recess 311 and also to function to limit the pivoting movement of the link 32 in an outward direction relative to the link 31, as is readily apparent from FIG. 3*a*.

Reference is now made to the embodiment of the invention shown in FIG. 4 which corresponds generally to that shown in FIG. 3, except for the locking means 418 which is an integral locking element of the link 41 housed within a recess 411 of the latter and disposed with its axis generally parallel to that of the transverse edges (unnumbered) of the links 41, 42. In this case, the links 41, 42 are articulated in the same manner as in the structure of the links 31, 32, namely, by interconnected shoulders or projections 421, 413, 414 and associated respective recesses 411, 423, 424. Again, the tensions in the longitudinal direction of the link band are absorbed in the same manner using an opening 426 of a rectangular configuration in a cleat, projection or tongue 416 and the latters respective cylindrical surfaces 419 and 429. The locking arm 418 is provided with an angled rim or flange 412 (FIG. 4*a*) functioning as the locking element which underlies a ledge 428 of the projection 421 in the manner illustrated in FIG. 4 and in FIG. 4*a*. However, the locking arm 418 can be deflected to the left, as viewed in FIGS. 4 and 4*a* to move the rim 412 from beneath the ledge 428 and permit relative outward pivoting of the links 41, 42 to permit the same to be easily separated, if so desired.

Reference is now made to FIGS. 5 and 6 of the drawings which illustrate another embodiment of the invention particularly adapted to be manufactured by a stamping or punching operation(s). For the sake of clarity, only a single link is shown, but it is to be understood that a link band is composed of a plurality of such identically formed and interconnected links. In this embodiment of the invention, the articulating connection is implemented by projection means which penetrate recess means of adjoining links, as in the manner heretofore described. To the latter end, the illustrated link 51 is provided along longitudinal sides or edges 511 or 512 with projection means 513 and 514 on one side and 515 and 516 on the other side with two recess means 517 and 518 on the one side and 519 and 520 on the other. Using these projection means and recess means, the links can be hooked up in the manner readily apparent from FIGS. 5 and 6 with, obviously, the projection means 521, 522 of one link, the link shown, being received in recesses corresponding to those of the recesses 519, 520 of another nonillustrated link, and so on.

In order to absorb the longitudinal tension, extensions or projections of the projecting means are indicated at 521, 522 and these extensions of the projection means 513, 514 seat behind surfaces or heels 527, 529 of the respective recesses 519, 520. The extensions or projections 521, 522 can displace mutually in the recesses 519, 520, respectively, on their associated support surfaces when the links pivot thereby effecting an operation corresponding to the embodiment of FIGS. 1 or 2. Again, the manner of mutually locking the link 51 to an identical link corresponds to the embodiment of FIG. 1 in that an arm 523 forming an integral homogeneous portion of the projecting means 522 is provided at its free end with a locking shoe or locking terminal end 524. The locking arm 523 is elastic and deflectable so that the locking shoe 524 can be forced back into a recess 517 of an associated adjoining link when two such identical links are hooked together. When the hooks are inserted, the locking shoe first slides over the projection means 515 and in the hook-up state rests by its front face against the side surface of this extension. By placing a tool in a depression 525 at the top side of the locking shoe 524 on the one hand and into a depression 526 in the side wall of the recess 520 on the other, the locking means can be released whereby adjoining interlocked links can be again separated.

Although only a preferred embodiment of the invention has been specifically illustrated and described herein, it is to be understood that minor variations may be made in the apparatus without departing from the spirit and scope of the invention, as defined in the appended claims.

I claim:

1. A link band, in particular a watch band, a bracelet or the like comprising a plurality of links each defined by opposite longitudinal edges, opposite transverse edges and opposite upper and lower surfaces; means for forming an articulating connection between adjacent links with the longitudinal edges thereof in adjacent relationship, said articulating connection means each having an axis of rotation located contiguous adjacent longitudinal edges and upper surfaces of adjacent links, said articulating connection means being a first pair of projection means of one link received in a first pair of recess means of another link, means for absorbing forces normal to said longitudinal edges which forces are imparted to the link band when in use, said normal forces absorbing means being a second pair of projection means of said another link, extending transverse to and bridging across said axis of rotation and having abutment means received in second recess means of said one link at a position remote from said axis of rotation to thereby absorb the tensile forces normal to said longitudinal edges, and said abutment means being operative to absorb the normal forces when said adjacent links are in a common plane.

2. The link band as defined in claim 1 wherein at least one of said pair of projection means are a pair of projections each having said abutment means formed by a bearing pin disposed generally transversely of its associated projection and being received in an associated recess means.

3. The link band as defined in claim 1 wherein said first and second pair of projection means are interdigitated relationship with each other.

4. The link band as defined in claim 1 wherein at least one of said first and second pair of projection means and said first and second recess means have generally cylindrical mating surfaces in coaxial relationship to the associated axis of rotation.

5. The link band as defined in claim 1 including cooperative abutment means defined by said one and another links for abutting each other when said link band is bent in an outward direction to limit outward bending of said links.

6. The link band as defined in claim 1 including cooperative abutment means defined by said one and another links for abutting each other when said link band is bent in an outward direction to limit outward bending of said links, and said cooperative abutment means being stepped to define abutment surfaces for abutting each other when said link band is bent in an outward direction to limit outward bending of said links.

7. The link band as defined in claim 1 including cooperative abutment means defined by said one and another links for abutting each other when said link band is bent in an outward direction to limit outward bending of said links, means for locking adjacent links together against unlocking movement of said links perpendicular to a longitudinal plane of the link band, and said locking means being an integral portion of said projection means having a terminal end portion spanning said longitudinal edges.

8. The link band as defined in claim 1 including cooperative abutment means defined by said one and another links for abutting each other when said link band is bent in an outward direction to limit outward bending of said links, means for locking adjacent links together against unlocking movement of said links perpendicular to a longitudinal plane of the link band, said locking means being an integral portion of one of said projection means having a terminal end portion spanning said longitudinal edges, and said integral portion being resilient and deflectable.

9. The link band as defined in claim 1 including cooperative abutment means defined by said one and another links for abutting each other when said link band is bent in an outward direction to limit outward bending of said links, means for locking adjacent links together against unlocking movement of said links perpendicular to a longitudinal plane of the link band, and said locking means being an integral portion of one of said first pair of projection means having a terminal end portion within said second recess means and spanning said longitudinal edges.

10. The link band as defined in claim 1 including cooperative abutment means defined by said one and another links for abutting each other when said link band is bent in an outward direction to limit outward bending of said links, means for locking adjacent links together against unlocking movement of said links perpendicular to a longitudinal plane of the link band, said locking means being an integral portion of one of said first pair of projection means having a terminal end portion within said second recess means and spanning said longitudinal edges, and said integral portion being resilient and deflectable.

11. The link band as defined in claim 1 wherein said first pair of projection means are defined by a pair of projections each having a terminal end projecting in a first common direction, said second pair of projecting abutment means being defined by a pair of projections each having a terminal end projecting in a second common direction, and said first and second directions are opposite each other.

12. The link band as defined in claim 1 including locking means carried by one of said first and second pair of projection means for locking receipts in one of said first and second recess means.

13. The link band as defined in claim 1 including locking means carried by one of said first and second pair of projection means for locking receipt in one of said first and second recess means in spanning relationship to adjacent longitudinal edges.

14. The link band as defined in claim 1 wherein said first and second pair of projection means are each defined by a pair of projections, and one of said projections carries means for locking adjacent links together against unlocking movement of the links parallel to said longitudinal edges.

15. The link band as defined in claim 1 wherein said first and second pair of projection means are each defined by a pair of projections, one of said projections carries means for locking adjacent links together against unlocking movement of the links parallel to said longitudinal edges, said locking means being a portion of said one projection received in one of said recess means confined against movement parallel to said longitudinal edges.

16. The link band as defined in claim 1 wherein said first and second pair of projection means are each defined by a pair of projections, one of said projections carries means for locking adjacent links together against unlocking movement of the links parallel to said longitudinal edges, said locking means being a portion of said one projection received in one of said recess means in spanning relationship to said longitudinal edges, and said projection portion being disposed generally between at least one of said first and second pair of projection means.

17. The link band as defined in claim 1 wherein said first and second pair of projection means are each defined by a pair of projections, one of said projections carries means for locking adjacent links together against unlocking movement of the links parallel to said longitudinal edges, said locking means being a portion of said one projection, and said one projection in part defining said articulating connection means.

* * * * *